US005101012A

United States Patent [19]

Lal

[11] Patent Number: 5,101,012

[45] Date of Patent: Mar. 31, 1992

[54] COMPOSITIONS AND POLYMER FABRICS TREATED WITH THE SAME

[75] Inventor: Kasturi Lal, Willoughby, Ohio

[73] Assignee: The Lubrizol Corporation, Wickliffe, Ohio

[21] Appl. No.: 740,687

[22] Filed: Aug. 6, 1991

Related U.S. Application Data

[63] Continuation of Ser. No. 494,204, Mar. 15, 1990.

[51] Int. Cl.[5] ..... C08G 69/42

[52] U.S. Cl. ..... 528/337; 528/342; 528/345; 564/144; 564/153

[58] Field of Search ..... 528/337, 342, 345; 564/139, 141, 144, 153

[56] References Cited

U.S. PATENT DOCUMENTS

| | | | |
|---|---|---|---|
| 4,520,155 | 5/1985 | Higgins | 524/166 |
| 4,738,676 | 4/1988 | Osborn, III | 604/385 |
| 4,753,834 | 6/1988 | Braun et al. | 428/74 |

FOREIGN PATENT DOCUMENTS 1453298 9/1966 France .

OTHER PUBLICATIONS

AMPS ® Monomer Brochure ( ®The Lubrizol Corporation 1987, 387360-43R).

*Primary Examiner*—James J. Bell

*Attorney, Agent, or Firm*—Forrest L. Collins; Frederick D. Hunter; James A. Cairns

[57] ABSTRACT

This invention relates to a composition prepared by reacting (a) at least one reaction product of a hydrocarbyl substituted carboxylic acid or anhydride having a hydrocarbyl group containing from about 8 to about 150 carbon atoms and at least one polyamine wherein the reaction product has at least one NH group capable of addition to a double bond; with (b) at least one sulfo compound represented by the following formula:

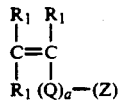

wherein each $R_1$ is independently hydrogen or a hydrocarbyl group;

a is zero or one;

Q is a hydrocarbylene group or —C(X)N($R_2$)Q'—;

$R_2$ is hydrogen or a hydrocarbyl group;

X is sulfur or oxygen;

each Q' is a hydrocarbylene group; and

Z is —S(O)OH, or —S(O)$_2$OH or an ester, a metal salt or an ammonium salt of the sulfo compound.

The invention also relates to polymer fabrics treated with the compositions of the present invention. The treated polymer fabrics have improved wicking/wetting characteristics. Further, the treated polymer fabrics maintain these characteristics upon repeated exposure to fluids.

14 Claims, No Drawings

COMPOSITIONS AND POLYMER FABRICS TREATED WITH THE SAME

This is a continuation of copending application Ser. No. 07/494,204 filed on Mar. 15, 1990, is now pending.

FIELD OF THE INVENTION

This invention relates to compositions useful as wetting agents and polymer fabrics treated with the same.

BACKGROUND OF THE INVENTION

Polymer fabrics are extensively used in a wide variety of products, ranging from disposable towel sheets to sanitary napkins and from disposable diapers to surgical sponges. All these applications involve the absorption of water or aqueous liquids (urine, blood, lymph, spills of coffee, tea, milk, etc.). The fabrics must have good wicking properties, i.e., water must be readily taken up and spread.

Polymer fabrics are generally hydrophobic. It is desirable to improve the wicking/wetting ability of the polymer fabrics. Often wetting agents are used to improve the ability of the polymer fabric to pass water and bodily fluids through the polymer fabric and into an absorbant layer. Further, it is desirable that the polymer fabric maintain its wicking/wetting characteristics after repeated exposure to water or aqueous liquids.

SUMMARY OF THE INVENTION

This invention relates to a composition prepared by reacting (a) at least one reaction product of a hydrocarbyl substituted carboxylic acid or anhydride having a hydrocarbyl group containing from about 8 to about 150 carbon atoms and at least one polyamine wherein the reaction product has at least one NH group capable of addition to a double bond; with (b) at least one sulfo compound represented by the following formula:

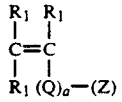

wherein each $R_1$ is independently hydrogen or a hydrocarbyl group;

a is zero or one;

Q is a hydrocarbylene group or $—C(X)N(R_2)Q'—$;

$R_2$ is hydrogen or a hydrocarbyl group;

X is sulfur or oxygen;

each Q' is a hydrocarbylene group; and

Z is $—S(O)OH$, or $—S(O)_2OH$ or an ester, a metal salt, or an ammonium salt of the sulfo compound.

The invention also relates to polymer fabrics treated with the compositions of the present invention. The treated polymer fabrics have improved wicking/wetting characteristics. Further, the treated polymer fabrics maintain these characteristics upon repeated exposure to aqueous fluids.

DESCRIPTION OF THE PREFERRED EMBODIMENTS

The carboxylic acids or anhydrides which are useful in making the wetting agents of the present invention are hydrocarbyl substituted mono- or polycarboxylic acids or anhydrides.

Preferably the hydrocarbyl group has from about 8 to about 150 carbon atoms, more preferably about 8 to about 100, more preferably from about 8 to about 50, more preferably from about 8 to about 30, more preferably about 8 to about 24, more preferably about 10 to about 18 carbon atoms Preferably, the hydrocarbyl group is an alkyl group, an alkenyl group, a polyalkene group or mixtures thereof, more preferably an alkyl or alkenyl group. The polyalkene group is characterized as having a number average molecular weight (Mn) of about 400 to about 2000, more preferably 800 to about 1500, more preferably 900 to about 1100.

In one embodiment, the carboxylic acid or anhydride has an octyl, decyl, dodecyl, tridecyl, tetradecyl, hexadecyl, octadecyl, decenyl, dodecenyl, tetradecenyl, hexadecenyl, octadecenyl, oleyl or soya group.

In another embodiment, the carboxylic acid or anhydride has an alkyl or alkenyl group having from about 8 to about 30 carbon atoms. The alkyl or alkenyl group may be derived from monoolefins having from about 2 to about 30 carbon atoms or oligomers thereof. The oligomers are generally prepared from olefins having less than 7 carbon atoms, preferably ethylene, propylene or butylene, more preferably propylene. A preferred oligomer has 12 carbon atoms and is a propylene tetramer group. The alkyl or alkenyl group may be derived from mixtures of monoolefins.

In another embodiment, the carboxylic acids or anhydrides have a polyalkene group which is a homopolymer or an interpolymer of polymerizable olefin monomers of 2 to about 16 carbon atoms, preferably 2 to about 6, more preferably 3 or 4. The interpolymers are those in which 2 or more olefin monomers are interpolymerized according to well known conventional procedures to form polyalkenes. The monoolefins are preferably ethylene, propylene, butylene, or octylene with butylene preferred. A preferred polyalkene substituent is a polybutenyl group.

The polyalkene substituted carboxylic acids may be used together with the fatty alkyl or alkenyl substituted carboxylic acids. The fatty groups are those having from about 8 to about 30 carbon atoms. It is preferred that the polyalkene substituted carboxylic acids and the fatty substituted carboxylic acids are used in mixtures of a weight ratio of from about (0–1.5:1), more preferably about (1:1).

Preferably the carboxylic acids or anhydrides are polycarboxylic acids or anhydrides.

The polycarboxylic acids are carboxylic acids or anhydrides having from 2 to about 4 carbonyl groups. The polycarboxylic acids of the present invention are preferably dimer acids, trimer acids or substituted succinic acids or anhydrides.

The dimer and trimer acids are the products resulting from the dimerization and trimerization of unsaturated fatty acids. Preferably the dimer acids are carboxylic acid products of the dimerization of $C_8$ to $C_{26}$ monomeric unsaturated fatty acids such as described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference. Examples of the dimerized $C_8$ to $C_{26}$ monomeric unsaturated fatty acids include but are not limited to such products as Empol® 1014 Dimer Acid and Empol® 1016 Dimer Acid each available from Emery Industries, Inc.

In another embodiment, the polycarboxylic acids are diacids which are the carboxylic acid products of the Diels-Alder type reaction of an unsaturated fatty acid with alpha,beta-ethylenically unsaturated carboxy acid (e.g., acrylic, methacrylic, maleic or fumaric acids) such as are taught in U.S. Pat. No. 2,444,328, the disclosure of which is incorporated herein by reference, and the Diels-Alder adduct of a three to four carbon atom alpha,beta-ethylenically unsaturated alkyl monocarboxylic or dicarboxylic acid (e.g., acrylic and fumaric acids respectively) and pimeric or abietic acids. Examples of the carboxylic acid product of a Diels-Alder type reaction include the commercially available Westvaco® Diacid 1525 and Westvaco® Diacid 1550, both being available from the Westvaco Corporation.

Preferably the polycarboxylic acid or anhydride is a succinic acid or anhydride.

The above carboxylic acids or anhydrides, including succinic acids and anhydrides as well as the above polyalkene groups are described in U.S. Pat. No. 4,234,435, issued to Meinhardt et al. This patent is incorporated by reference for its disclosure of carboxylic acids or anhydrides, sometimes referred to as carboxylic acylating agents, polyalkene groups and methods for making the same.

The above carboxylic acids or anhydrides are reacted with polyamines. The reaction product is characterized as having at least one NH group capable of addition to a double bond.

The polyamines may be aliphatic, cycloaliphatic, heterocyclic or aromatic. Examples of the polyamines include alkylene polyamines, heterocyclic polyamines and amine terminated polyoxyalkylene.

Alkylene polyamines may be represented by the formula

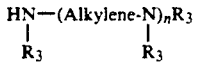

wherein n has an average value between about 1 and about 0, preferably about 2 to about 7 and the "Alkylene" group has from 1 to about 10 carbon atoms, preferably about 2 to about 6. As noted above, $R_3$ is preferably an aliphatic or hydroxy-substituted aliphatic group of up to about 30 carbon atoms.

Such alkylene polyamines include methylene polyamines, ethylene polyamines, butylene polyamines, propylene polyamines, pentylene polyamines, etc. The higher homologs and related heterocyclic amines such as piperazines and N-amino alkyl-substituted piperazines are also included. Specific examples of such polyamines are ethylene diamine, triethylene tetramine, tris-(2-aminoethyl)amine, propylene diamine, trimethylene diamine, tripropylene tetramine, tetraethylene pentamine, hexaethylene heptamine, pentaethylenehexamine, etc.

Higher homologs obtained by condensing two or more of the above-noted alkylene amines are similarly useful as are mixtures of two or more of the aforedescribed polyamines.

Ethylene polyamines, such as some of those mentioned above, are useful. Such polyamines are described in detail under the heading Ethylene Amines in Kirk Othmer's "Encyclopedia of Chemical Technology", 2d Edition, Vol. 7, pages 22-37, Interscience Publishers, N.Y. (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as piperazines. Ethylene polyamine mixtures are useful.

In another embodiment, the polyamines are branched polyalkylene polyamines. The branched polyalkylene polyamines are polyalkylene polyamines wherein the branched group is a side chain containing on the average at least one nitrogen-bonded aminoalkylene group per nine amino units present on the main chain, for example, 1-4 of such branched chains per nine units on the main chain, but preferably one side chain unit per nine main primary amino groups and at least one tertiary amino group.

These reagents may be expressed by the formula:

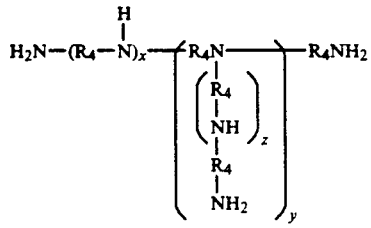

wherein each $R_4$ is independently an alkylene group such as ethylene, propylene, butylene and other homologs (both straight chained and branched), etc., but preferably ethylene; and x, y and z are integers, x being, for example, from 4 to 24 or more but preferably 6 to 18, y being, for example, 1 to 6 or more but preferably 1 to 3, and z being, for example, 0-6 but preferably 0-1. The x and y units may be sequentially, alternatively, orderly or randomly distributed.

The preferred class of such polyamines includes those of the formula:

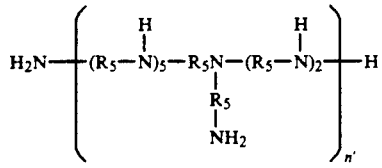

wherein n is an integer, for example, 1-20 or more but preferably 1-3, and $R_5$ is preferably ethylene, but may be propylene, butylene, etc. (straight-chained or branched).

The preferred embodiments are presented by the following formula:

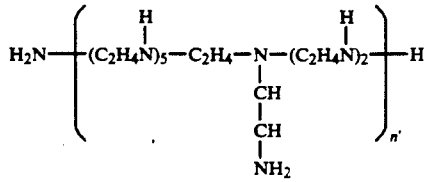

The groups in the parentheses may be joined in a head-to-head or a head-to-tail fashion. Compounds described by this formula wherein n'=1-3 are manufactured and sold as Polyamines N-400, N-800, N-1200, etc. Polyamine N-400 has the above formula wherein $n'=1$.

U.S. Pat. Nos. 3,200,106 and 3,259,578 are incorporated herein by reference for their disclosure of how to make such polyamines and processes for reacting them with carboxylic acid acylating agents.

Hydroxyalkyl alkylene polyamines having one or more hydroxyalkyl substituents on the nitrogen atoms, are also useful in preparing compositions of the present invention. Preferred hydroxyalkyl-substituted alkylene polyamines are those in which the hydroxyalkyl group is a lower hydroxyalkyl group, i.e., having less than eight carbon atoms. Examples of such hydroxyalkyl-substituted polyamines include N-(2-hydroxyethyl-)ethylene diamine, N,N-bis(2-hydroxyethyl)ethylene diamine, 1-(2-hydroxyethyl)piperazine, monohydroxypropyl-substituted diethylene triamine, dihydroxypropyl-substituted tetraethylene pentamine, N-(3-hydroxybutyl)tetramethylene diamine, etc. Higher homologs as are obtained by condensation of the above-illustrated hydroxy alkylene polyamines through amino radicals or through hydroxy radicals are likewise useful as amines in this invention. Condensation through amino radicals results in a higher amine accompanied by removal of ammonia and condensation through the hydroxy radicals results in products containing ether linkages accompanied by removal of water.

The amine may also be a heterocyclic polyamine. Among the heterocyclic polyamines are aziridines, azetidines, azolidines, tetra- and dihydropyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkylsubstituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminoethylpiperazine, and N,N'-diaminoethylpiperazine.

In another embodiment the polyamine is amine terminated polyoxyalkylene; such as amino polyoxypropylene-polyoxyethylene-polyoxypropylene, or amino polyoxypropylene. These amines are generally prepared by the reaction of a monohydric alcohol with an epoxide, such as styrene oxide, 1,2-butene oxide, ethylene oxide, propylene oxide and the like, more preferably ethylene oxide, propylene oxide or mixtures thereof. The terminal hydroxyl group is then converted to an amino groups.

In one embodiment, the amine terminated polyoxyalkylene is a diamine such as preferably amine terminated polypropylene glycols. These diamines are represented by the formula $$H_2NC(H)(CH_3)-CH_2-(OCH_2-CH(CH_3))_b-NH_2$$

wherein b is from 1 to about 150, preferably 2 to about 100, more preferably 2 to about 75. Examples of these amines include Jeffamine® D-230 wherein b is about 2-3;, Jeffamine® D-400 wherein b is about 5-6, Jeffamine® D-2000 wherein b is an average of about 33, and Jeffamine® D-4000 wherein b is an average of about 68.

In another embodiment, the diamines are represented by the formula $$H_2NCH(CH_3)CH_2-(OCH(CH_3)CH_2)_d-(OCH_2CH_2)_e-(OCH_2CH(CH_3))_g-NH_2$$

wherein d is a number in the range of from zero to about 200; e is a number in the range of form about 10 to about 650; and g is a number in the range of from zero to about 200. These diamines preferably have number average molecular weights in the range of about 600 to about 6,000, more preferably about 600 to about 2,000. Specific examples of the diamines include Jeffamine® ED-600 wherein d+g is approximately 2.5 and e is approximately 8.5; Jeffamine® ED-900 wherein d.g is approximately 2.5 and e is approximately 15.5; and Jeffamine® ED-2001 wherein d+g is approximately 2.5 and e is approximately 40.5.

In another embodiment, the diamines are represented by the formula $$H_2NCH(CH_3)-CH_2(OCH_2CH(CH_3))_jNH-C(=O)-NH(CH(CH_3)-CH_2O)_jCH_2CH(CH_3)-NH_2$$

wherein j is a number sufficient to provide said compound with a number average molecular weight of at least about 600. These compounds preferably have number average molecular weights in the range of about 600 to about 2,500, more preferably about 700 to about 2,200.

In another embodiment, the amine terminated polyoxyalkylene is a triamine prepared by treating a triol with ethylene oxide, propylene oxide, or mixtures thereof, followed by amination of the terminal hydroxyl group. These amines are available commercially available from Texaco Chemical Company under the tradename Jeffamine® triamines. Examples of these amines include Jeffamine® T-403, which is trimethylolpropane treated with about 5-6 moles of propylene oxide, Jeffamine® T-3000, which is glycerine treated with 50 moles of propylene oxide, and Jeffamine® T-5000, which is glycerine treated with 85 moles of propylene oxide.

The diamines and triamines that are useful in accordance with the present invention are disclosed in U.S. Pat. Nos. 3,021,232; 3,108,011; 4,444,566; and Re. 31,522. The disclosures of these patents are incorporated herein by reference.

The polyamines are reacted with carboxylic acids or anhydrides to form a reaction product which has at least one NH capable of adding across a double bond. The polyamine is usually reacted with a carboxylic acid or anhydride in an equivalent ratio of about (1:2-10), more preferably (1:2-4), more preferably (1:2). The reaction between the polyamine and the carboxylic acid or anhydride occurs at room temperature to just below the decomposition temperature of the reactants or the reaction mixture, more preferably from room temperature to about 250° C., more preferably from 75° C. to about 175° C. The reaction time is usually between 0.25 to about 8 hours, more preferably 0.5 to about 4 hours, more preferably 0.5 to about 2 hours.

EXAMPLE 1

A reaction vessel, equipped with a mechanical stirrer, a thermometer, a dropping funnel, a water trap and a condenser, is charged with 400 parts (2.0 moles) of tetraethylenepentamine and 600 parts of xylene. The mixture is heated to 120° C., then 665 parts (2.5 moles) of a propylenetetramer succinic anhydride is added dropwise over 2 hours and 20 minutes. The reaction mixture is heated to 132° C. and 40 milliliters of water is collected in 2 hours. The reaction temperature is then raised to 145° C. and held for 7 hours, while an additional 10 milliliters of water is collected. The reaction mixture is vacuum stripped to 120° C. and 10 millimeters of mercury. The residue is an orange-yellow liquid having 13.4% nitrogen (theoretical 13.72%).

The above reaction products of a carboxylic acid or anhydride with a polyamine is further reacted with a sulfo compound of the general formula:

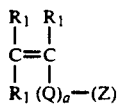

wherein each $R_1$ is independently hydrogen or a hydrocarbyl group; a is zero or one, preferably one; Q is a hydrocarbylene group or $—C(X)N(R_2)Q'—R_2$ is hydrogen or a hydrocarbyl group; X is sulfur or oxygen, preferably oxygen; Q' is a hydrocarbylene group; and Z is $—S(O)OH$ or $—S(O)_2OH$, preferably $—S(O)_2OH$.

Each $R_1$ and $R_2$ is independently a hydrogen or an alkyl group having from 1 to 12 carbon atoms, preferably from 1 to about 6, more preferably 1 to about 4. Preferably, each $R_1$ and $R_2$ is independently hydrogen, or a methyl, ethyl, propyl or butyl group.

Preferably, each Q and Q' is independently selected from the group consisting of alkylene, arylene, alkylarylene, arylalkylene, more preferably alkylene. Q Q' contain from 1 to about 24 carbon atoms, preferably 1 to about 18, more preferably 1 to 12, except where Q or Q' are arylene, alkylarylene or arylalkylene, where they contain from 6 to about 24 carbon atoms, more preferably 6 to about 18, more preferably 6 to about 12 Q is preferably alkylene or $—C(X)NR_2Q'—$, with $—C(X)NR_2Q'—$ being more preferred.

Examples of Q and Q' include, but are not limited to, methylene, ethylene, propylene, butylene, octylene, decylene, tolylene, naphthylene, cyclohexylene, cyclopentylene, dimethylethylene, diethylethylene, butylpropylethylene and the like, preferably dimethylethylene.

Useful sulfo compounds are sulfonic acid containing compounds. Sulfonic acid containing compounds useful in the present invention include vinyl alkyl sulfonic acids, and vinyl aromatic sulfonic acids. Examples of useful sulfonic acid compounds include vinyl sulfonic acid, vinyl naphthalene sulfonic acid, vinyl anthracene sulfonic acid, vinyl toluene sulfonic acid, methallylsulfonic acid (2-methyl- 2-propene-1-sulfonic acid) and acrylamidohydrocarbyl sulfonic acid.

A particularly useful acrylamidohydrocarbyl sulfonic acid is 2-acrylamido-2-methylpropane sulfonic acid. This compound is available from The Lubrizol Corporation, Wickliffe, Ohio, U.S.A. under the trademark AMPS® Monomer. Other useful sulfo compounds include: 2-acrylamidoethane sulfonic acid, 2-acrylamidopropane sulfonic acid, 3-methylacrylamidopropane sulfonic acid, 1,1-bis(acrylamido)-2-methylpropane-2-sulfonic acid, and the like.

The above sulfo compounds may react as a sulfo acid or an ester, ammonium salt or metal salt of the sulfo acid. The ester may be formed by reacting the above sulfo acid with 1) a trialkylphosphate; 2) sulfur trioxide and an alcohol; 3) dialkylsulfate in dimethylformamide; 4) silver oxide and alkyl halide; and 5) alkylene oxide. The reactions described above are known to those in the art.

The preparation of esters of amido alkane sulfonic acid are described in U.S. Pat. Nos. 3,937,721; 3,956,354; 3,960,918; and German Patent 2,420,738.

Preferred esters are those having from 1 to about 40, preferably from 1 to about 20, more preferably from 1 to about 10, more preferably from 1 to about 6 carbon atoms in the ester group. Methyl esters are preferred.

When the sulfo compound is an ammonium salt, the ammonium salt may be prepared from ammonia, or any amine. The amine may be a mono- or polyamine. The polyamine may be any one of the polyamines discussed above. Preferably the salt is formed from ammonia, an alkylamine or a hydroxyamine.

In one embodiment, the amine is a monoamine. The monoamine generally contains from 1 to about 24 carbon atoms, with 1 to about 12 being more preferred, with 1 to about 6 being more preferred. Examples of primary amines useful in the present invention include methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary amine include trimethylamine, tributylamine, methyldiethylamine, ethyldibutylamine, etc.

In another embodiment the amines are hydroxyamines. Typically, the hydroxyamines are primary, secondary or tertiary alkanol amines or mixtures thereof. Such amines can be represented by the formulae:

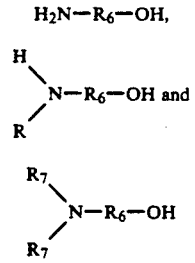

wherein each $R_7$ is independently a hydrocarbyl group of one to about eight carbon atoms or hydroxyhydrocarbyl group of two to about eight carbon atoms and $R_6$ is a divalent hydrocarbyl group of about two to about 18 carbon atoms. The group $—R_6—OH$ in such formulae represents the hydroxyhydrocarbyl group. $R_6$ can be an acyclic, alicyclic or aromatic group. Typically, $R_6$ is an acyclic straight or branched alkylene group such as an ethylene, 1,2-propylene, 1,2-butylene or 1,2-octadecylene group, more preferably an ethylene or propylene group, more preferably an ethylene group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R_7$ is independently a methyl, ethyl, propyl, butyl, pentyl or hexyl group.

Examples of these hydroxyamines include monoethanol amine, diethanol amine, triethanol amine, diethylethanol amine, ethylethanol amine, etc.

The hydroxyamines can also be an ether N-(hydroxyhydrocarbyl)amine. These are hydroxypoly(hydrocarbyloxy) analogs of the above-described hydroxyamines (these analogs also include hydroxyl-substituted oxyalkylene analogs). Such N-(hydroxyhydrocarbyl) amines can be conveniently prepared by reaction of epoxides with afore-described amines and can be represented by the formulae:

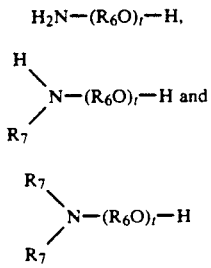

wherein t is a number from about 2 to about 15 and $R_6$ and $R_7$ are as described above. $R_7$ may also be a hydroxypoly(hydrocarbyloxy) group.

In a preferred embodiment, the ammonium salts of the sulfo compound are formed from hydroxyamines These hydroxyamines can be represented by the formula

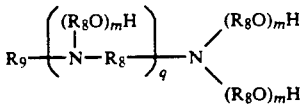

wherein each $R_3$ is an alkylene group; $R_5$ is a hydrocarbyl group; each m is independently an integer from zero to 100, provided at least one m is an integer greater than zero; and q is zero or one.

Preferably, $R_9$ is a hydrocarbyl group having from 8 to about 30 carbon atoms, preferably 8 to about 24, more preferably 10 to about 18 carbon atoms. $R_9$ is preferably an alkyl or alkenyl group, more preferably an alkenyl group. $R_9$ is preferably a decyl, dodecyl, tetradecyl, hexadecyl, octadecyl, decenyl, dodecenyl, tetradecenyl, hexadecenyl, or octadecenyl.

m is preferably one to about 100, more preferably 2 to about 50, more preferably 2 to about 20, more preferably 3 to about 10, more preferably about 5.

$R_8$ is as described above. Preferably, each $R_8$ is independently an ethylene or propylene group.

The above hydroxyamines can be prepared by techniques well known in the art, and many such hydroxyamines are commercially available. They may be prepared, for example, by reaction of primary amines containing at least 6 carbon atoms with various amounts of alkylene oxides such as ethylene oxide, propylene oxide, etc. The primary amines may be single amines or mixtures of amines such as obtained by the hydrolysis of fatty oils such as tallow oils, sperm oils, coconut oils, etc. Specific examples of fatty acid amines containing from about 8 to about 30 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The useful hydroxyamines where q in the above formula is zero include 2-hydroxyethylhexylamine, 2-hydroxyethyloctylamine, 2-hydroxyethylpentadecylamine, 2-hydroxyethyloleylamine, 2-hydroxyethylsoyamine, bis(2-hydroxyethyl)hexylamine, bis(2-hydroyyethyl)oleylamine, and mixtures thereof. Also included are the comparable members wherein in the above formula at least one m is an integer greater than 2, as for example, 2-hydroxyethoxyethylhexylamine.

A number of hydroxyamines wherein q is zero are available from the Armak Chemical Division of Akzona, Inc., Chicago, Ill., under the general trade designation "Ethomeen" and "Propomeen" Specific examples of such products include "Ethomeen C/15" which is an ethylene oxide condensate of a cocoamine containing about 5 moles of ethylene oxide; "Ethomeen C/20" and "C/25" which also are ethylene oxide condensation products from cocoamine containing about 10 and 15 moles of ethylene oxide respectively; "Ethomeen 0/12" which is an ethylene oxide condensation product of oleylamine containing about 2 moles of ethylene oxide per mole of amine. "Ethomeen S/15" and "S/20" which are ethylene oxide condensation products with soyaamine containing about 5 and 10 moles of ethylene oxide per mole of amine respectively; and "Ethomeen T/12, T/15" and "T/25" which are ethylene oxide condensation products of tallowamine containing about 2, 5 and 15 moles of ethylene oxide per mole of amine respectively. "Propomeen 0/12" is the condensation product of one mole of oleyl amine with 2 moles propylene oxide. Preferably, the salt is formed from Ethomeen C/15 or S/15 or mixtures thereof.

Commercially available examples of hydroxyamines where b is one include "Ethoduomeen T/13", "T/20", and "T/25" which are ethylene oxide condensation products of N-tallow trimethylene diamine containing 3, 10 and 15 moles of ethylene oxide per mole of diamine, respectively.

The fatty polyamine diamines include mono- or dialkyl, symmetrical or asymmetrical ethylene diamines, propane diamines (1,2, or 1,3), and polyamine analogs of the above. Suitable commercial fatty polyamines are "Duomeen C" (N-coco-1,3-diaminopropane), "Duomeen S" (N-soya-1,3-diaminopropane), "Duomeen T" (N-tallow-1,3-diaminopropane), or "Duomeen 0" (N-oleyl-1,3-diaminopropane). "Duomeens" are commercially available diamines described in Product Data Bulletin No. 7-10R1 of Armak Chemical Co., Chicago, Ill. In another embodiment, the secondary amines may be cyclic amines such as piperidine, piperazine, morpholine, etc.

The ammonium salts of the sulfo compound may be prepared from ammonia or an amine. These salts are usually prepared at a temperature of from about 30° C.

to about 110° C., with about 30° C. to about 80° C. being preferred.

When the sulfo compound is a metal salt, the metal salt may be prepared by the reaction of the acid with an alkali, an alkaline earth or transition metal compound. The metal compounds are usually in the form of metal oxides, hydroxides, carbonates, sulfates, etc. Examples of metal compounds include sodium hydroxide or oxide, potassium hydroxide or oxide, calcium hydroxide or carbonate, zinc oxide or hydroxide, manganese oxide or hydroxide, magnesium oxide or hydroxide etc. The metal of the metal compound includes preferably sodium, potassium, calcium, magnesium, zinc or aluminum, more preferably sodium or potassium. The reaction usually occurs at a temperature of from about ambient temperature to about 150° C., with about 30° C. to about 125° C. being preferred. The acid is reacted with the metal compound in roughly stoichiometric amounts. A slight excess of metal-containing compound may be used.

The above sulfo compound is reacted with the reaction product of a carboxylic acid or anhydride and a polyamine at an equivalent ratio of about (1:1-10), more preferably about (1:1-4), more preferably about (1:1-1.1). An equivalent of reaction product is the amount which delivers one NH group to the reaction. An equivalent of sulfo compound is the amount of sulfo compound which delivers one double bond to the reaction. The reaction of the NH group and the double bond is base catalyzed. Therefore a slight excess of the above reaction product may be used. When the sulfo compound is an acid, an excess of the above reaction product is required. The reaction occurs between about 50° C. and about 200° C., more preferably about 75° C. to about 175° C., more preferably about 100° C. to about 150° C. . Typically the reaction time is between one-fourth to about 20 hours, more preferably about 2 to about 10 hours.

The following are examples of compositions useful in the present invention. Unless otherwise indicated, the temperature is degrees Celsius and parts are parts by weight.

EXAMPLE 2

A reaction vessel, equipped with a mechanical stirrer, a thermometer, and a condenser, is charged with 128 parts (0.25 mole) of the product of Example 1 and 593 parts (1.5 moles) of a 58% by weight solution of the sodium salt of 2-acrylamido-2-methyl-propane sulfonic acid in water. The reaction mixture is heated to 100° C. and held for 12 hours. An additional 99 parts (0.25 mole) of the sodium salt described above is added and the reaction temperature is maintained at 100° C. for 12 hours. The product contains 35% by weight water.

EXAMPLE 3

A reaction vessel, equipped with a mechanical stirrer, a thermometer, a dropping funnel, a water trap and a condenser, is charged with 61 parts (1.5 moles) of E-100, a polyamine bottom having about 40% primary amino groups and about 40% secondary amino groups available from Dow Chemical Co., and 300 parts xylene. The mixture is heated to 120° C. wherein 561 parts (0.5 mole) of a polybutenyl succinic anydride, having a polybutenyl group having a number average molecular weight of about 950, is added over 3¼ hours. The reaction temperature is maintained at 120° C. for 4½ hours while seven milliliters of distillate is collected. The reaction temperature is increased to 140° C. and maintained for eight hours. The reaction mixture is vacuum-stripped at 100°-140° C. and 15 millimeters of mercury. The residue is cooled to 120° C. where 400 parts of distilled water and 257 parts (0.65 mole) of a 58% by weight solution of the sodium salt of 2-acrylamido-2-methylpropane sulfonic acid in water is added over one hour. The reaction temperature is maintained at 100° C. for five hours. The product has 2.43% nitrogen (theoretical 2.34%); 1.48% sulfur (theoretical 1.64%); and 1.22% sodium (theoretical 1.18%).

EXAMPLE 4

A reaction vessel, equipped as described in Example 2, is charged with 127.5 parts (0.25 mole) of the product of Example 1 and 395 parts (1.0 mole) of the solution of sodium salt of 2-acrylamido-2-methylpropane sulfonic acid described in Example 2. The mixture is heated to 105° C. . The temperature is maintained for two and one-fourth hours. The mixture is cooled to 60° C. and 77.7 parts (0.38 mole) of 2-acrylamido-2-methylpropane sulfonic acid is added to the vessel. The mixture is heated to 100° C. and the temperature is maintained for three hours while 100 parts of water is removed. The product has 28% by weight water as diluent.

The polymer fabrics which are treated with wetting agents may be any polymer fabric, preferably a woven or nonwoven fabric, more preferably a nonwoven fabric. The polymer fabric may be prepared by any method known to those skilled in the art. When the fabric is nonwoven, it may be a spunbonded or melt-blown polymer fabric, preferably a spunbonded fabric. Spin-bonding and melt-blowing processes are known to those in the art.

The polymer fabric may be prepared from any thermoplastic polymer. The thermoplastic polymer can be a polyester, polyamide, polyurethane, polyacrylic, polyolefin, combinations thereof, and the like. The preferred material is polyolefin.

The polyolefins are polymers which are essentially hydrocarbon in nature. They are generally prepared from unsaturated hydrocarbon monomers. However, the polyolefin may include other monomers provided the polyolefin retains its hydrocarbon nature. Examples of other monomers include vinyl chloride, vinyl acetate, acrylic acid or esters, methacrylic acid or esters, acrylamide and acrylonitrile. Preferably, the polyolefins are hydrocarbon polymers. The polyolefins include homopolymers, copolymers and polymer blends.

Copolymers can be random or block copolymers of two or more olefins. Polymer blends can utilize two or more polyolefins or one or more polyolefins and one or more nonpolyolefin polymers. As a practical matter, homopolymers and copolymers and polymer blends involving only polyolefins are preferred, with homopolymers being most preferred.

Examples of polyolefins include polyethylene, polystyrene, polypropylene, poly(1-butene), poly(2-butene), poly(1-pentene), poly(2-pentene), poly(3-methyl- 1-pentene), poly(4-methyl-1-pentene), poly-1,3-butadiene and polyisoprene, more preferably polyethylene an polypropylene.

The wetting agents of the present invention are usually applied to the fabric as a 0.25 to about 2%, more preferably 0.5 to about 1%, more preferably 0.5 to about 0.75% by weight organic or aqueous mixture. The mixture may be a solution or dispersion. The organic mixture may be prepared by using volatile organic solvents. Useful organic solvents include alcohols, such as alcohols having from 1 to about 6 carbon atoms, including butanol and hexanol; or ketones, such as acetone or methylethylketone. Preferably the wetting agents are applied as an aqueous solution or dispersion. The wetting agents may be applied either by spraying the fabric or dipping the fabric into the mixture. After application of the wetting agents, the treated fabric is dried by any ordinary drying procedure such as drying at 120° C. for approximately 3 to 5 minutes.

A cowetting agent may be used to reduce wetting time of the above aqueous mixture. The cowetting agent is preferably a surfactant, more preferably a nonionic surfactant, more preferably a nonionic surfactant. Useful surfactants include the above described alkyl terminated polyoxyalkylenes, and alkoxylated phenols. Preferably, the surfactant is an alkyl terminated polyoxyalkylene.

The wetting time of the wetting agent mixture may also be reduced by heating the mixture. Usually the wetting agents are applied at room temperature. However, a 10°-15° C. increase in temperature significantly reduces wetting time.

Preferably, the treated polymer fabrics after drying contain from about 0.1 to about 3%, more preferably about 0.1 to about 1%, more preferably about 0.5 to about 0.8% pickup based on the weight of the fabric. Percent pickup is the percentage by weight of wetting agent on a polymer fabric.

The following Table contains examples of polypropylene fabrics treated with aqueous solutions or dispersions of wetting agents. The polymer fabric may be any polypropylene fabric available commercially. The aqueous solution or dispersion is applied in the concentration shown in the Table. The polypropylene fabric is dipped into the aqueous solution or dispersion and then dried for 3-5 minutes at 125° C. .

TABLE

| Examples | Wetting Agent | Amount Wetting Agent In Water |
|---|---|---|
| A | Example 2 | 1% |
| B | Example 3 | 0.75% |
| C | Example 3 | 0.5% |
| D | Example 4 | 0.75% |

The treated polymer fabrics have improved hydrophilic character. The treated fabrics show an improvement in the wicking/wetting. The polymer fabrics of the present invention may be formed into diapers, feminine products, surgical gowns, breathable clothing liners and the like by procedures known to those in the art The properties of the treated fabrics or products made with the fabrics may be measured by ASTM Method E 96-80, Standard Test Methods for Water Vapor Transmission of Materials, and INDA Standard Test 80 7-70 (82), INDA Standard Test for Saline Repellency of Nonwovens, often referred to as the Mason Jar Test. The later test uses a 0.9% by weight saline solution.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

Claims:

1. A composition prepared by reacting (a) at least one reaction product of a hydrocarbyl substituted carboxylic acid or anhydride having a hydrocarbyl group containing from about 8 to about 150 carbon atoms and at least one polyamine wherein the reaction product has at least one NH group capable of addition to a double bond; with (b) at least one sulfo compound represented by the following formula:

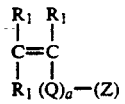

wherein each $R_1$ is independently hydrogen or a hydrocarbyl group;

a is 0 or 1;

Q is a hydrocarbylene group or —C(X)N($R_2$)Q'—;

$R_2$ is hydrogen or a hydrocarbyl group;

X is sulfur or oxygen;

each Q' is a hydrocarbylene group; and

Z is —S(O)OH, or —S(O)$_2$OH or an ester, a metal salt or an ammonium salt of the sulfo compound.

2. The composition of claim 1, wherein $R_1$ and $R_2$ are each independently hydrogen or alkyl groups having from 1 to about 12 carbon atoms; a is 1; and Q is an arylene or alkarylene group having from 6 to about 18 carbon atoms, an alkylene group having from 1 to about 18 carbon atoms, or —C(O)N($R_2$)Q'—.

3. The composition of claim 1, wherein a is 1 and Q is —C(O)N($R_2$)Q'— and Q' is a hydrocarbylene group having from 1 to about 16 carbon atoms.

4. The composition of claim 1, wherein a is 1 and Q is an arylene group having from 6 to about 12 carbon atoms.

5. The composition of claim 1, wherein a is 1, Q is —C(O)N($R_2$)Q'— and Q' is an alkylene group having from 1 to about 8 carbon atoms.

6. The composition of claim 1, wherein a is 1, Q is —C(O)N($R_2$)Q'— and Q' is dimethylethylene.

7. The composition of claim 1, wherein the hydrocarbyl group of (a) is an alkyl or alkenyl group having from about 8 to about 30 carbon atoms; a polyalkene group having a number average molecular weight of from about 400 to about 2000; or mixtures thereof.

8. The composition of claim 1, wherein the hydrocarbyl group of (a) is an alkyl or alkenyl group having from about 8 to about 24 carbon atoms.

9. The composition of claim 1, wherein the hydrocarbyl group of (a) is a polyalkene group having a number average molecular weight from about 900 to about 1100.

10. The composition of claim 1, wherein the polyamine of (a) is a polyalkylene polyamine or an amine terminated polyoxyalkylene.

11. The composition of claim 1, wherein the polyamine of (a) is tetraethylenepentamine, diethylenetriamine or pentaethylenehexamine.

12. The composition of claim 1 wherein the polyamine is an amine terminated polyoxyethylene, polyoxypropylene, or mixtures thereof.

13. The composition of claim 1, wherein the reaction product (a) is prepared by reacting the carboxylic acid or anhydride with the polyamine at an equivalent ratio of about (1:2-10).

14. The composition of claim 1, wherein (a) and (b) are reacted at an equivalent ratio of about (1:1-10).

* * * * *